US011305956B2

(12) United States Patent
Kiyose et al.

(10) Patent No.: US 11,305,956 B2
(45) Date of Patent: Apr. 19, 2022

(54) TRANSPORT DEVICE

(71) Applicant: SEIKO EPSON CORPORATION, Tokyo (JP)

(72) Inventors: Kanechika Kiyose, Matsumoto (JP); Tomohide Onogi, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 121 days.

(21) Appl. No.: 16/807,822

(22) Filed: Mar. 3, 2020

(65) Prior Publication Data

US 2020/0283252 A1 Sep. 10, 2020

(30) Foreign Application Priority Data

Mar. 4, 2019 (JP) ..... JP2019-038303

(51) Int. Cl.
*B65H 7/12* (2006.01)
*B65H 3/06* (2006.01)
*B65H 3/52* (2006.01)

(52) U.S. Cl.
CPC ..... *B65H 7/125* (2013.01); *B65H 3/063* (2013.01); *B65H 3/5284* (2013.01); *B65H 2553/30* (2013.01)

(58) Field of Classification Search
CPC ..... B65H 7/125; B65H 3/063; B65H 3/5284; B65H 2553/30
See application file for complete search history.

(56) References Cited

U.S. PATENT DOCUMENTS 5,126,946 A * 6/1992 Ko ..... B65H 23/0204 226/15
9,745,160 B2 * 8/2017 Hongo ..... B65H 5/062
2013/0093136 A1 * 4/2013 Sakharshete ..... G03G 15/6511 271/258.01
2014/0054844 A1 * 2/2014 Morikawa ..... B65H 3/0653 271/18
2017/0126912 A1 5/2017 Shuto
2017/0359475 A1 * 12/2017 Xie ..... H04N 1/0032

FOREIGN PATENT DOCUMENTS

JP 2004182449 A * 7/2004
JP 2009292573 A * 12/2009
JP 2014-043306 A 3/2014
JP 2017-088259 A 5/2017

* cited by examiner

*Primary Examiner* — Howard J Sanders
(74) *Attorney, Agent, or Firm* — Oliff PLC

(57) ABSTRACT

A transport device includes: a medium support unit having a placement surface where a sheet-like medium is placed; a transport unit supplied with the medium placed at the placement surface and transporting the medium in a transport direction along a sheet surface of the medium; an ultrasonic transmitting unit provided at a part of the medium support unit and transmitting an ultrasonic wave; an ultrasonic receiving unit provided at another part of the medium support unit, and receiving the ultrasonic wave and outputting a received signal; and a floating detection unit determining whether a floating of the medium from the placement surface is present or not, based on the received signal.

4 Claims, 13 Drawing Sheets

TRANSPORT DEVICE

The present application is based on, and claims priority from JP Application Serial Number 2019-038303, filed Mar. 4, 2019, the disclosure of which is hereby incorporated by reference herein in its entirety.

BACKGROUND

1. Technical Field

The present disclosure relates to a transport device.

2. Related Art

According to the related art, an image scanner, printer or the like uses a transport device that automatically feeds a sheet-like medium. Such a transport device has a configuration to prevent a multi-feed of media. For example, a transport device described in JP-A-2017-88259 has a feed roller feeding media (sheets) placed at a tray to a transport path, and a retard roller (separation roller) separating the media fed to the transport path, one by one.

However, when a plurality of media partly bound (stapled) together is placed by mistake at the tray of the transport device as described above, the separation of the media by the retard roller is not performed properly, resulting in a jam or a so-called paper jam.

SUMMARY

A transport device according to an aspect of the present disclosure includes: a medium support unit having a placement surface where a sheet-like medium is placed; a transport unit supplied with the medium placed at the placement surface and transporting the medium in a transport direction along a sheet surface of the medium; an ultrasonic transmitting unit provided at a part of the medium support unit and transmitting an ultrasonic wave; an ultrasonic receiving unit provided at another part of the medium support unit, and receiving the ultrasonic wave and outputting a received signal; and a floating detection unit determining whether a floating of the medium from the placement surface is present or not, based on the received signal.

In the transport device according to the aspect of the present disclosure, the medium support unit may have a first guide and a second guide coming into contact with the medium placed at the placement surface from both sides of a direction along the sheet surface and orthogonal to the transport direction, and guiding the medium in the transport direction. The ultrasonic transmitting unit may be provided at the first guide. The ultrasonic receiving unit may be provided at the second guide.

In the transport device according to the aspect of the present disclosure, the medium support unit may have a first guide and a second guide coming into contact with the medium placed at the placement surface from both sides of a direction along the sheet surface and orthogonal to the transport direction, and guiding the medium in the transport direction. One of the ultrasonic transmitting unit and the ultrasonic receiving unit may be provided at the first guide or the second guide. The other may be provided at the placement surface.

In the transport device according to the aspect of the present disclosure, the ultrasonic transmitting unit may transmit the ultrasonic wave in a plurality of transmission directions.

In the transport device according to the aspect of the present disclosure, the ultrasonic transmitting unit may transmit the ultrasonic wave in a direction along the sheet surface and intersecting the transport direction.

The transport device according to the aspect of the present disclosure may further include a notification unit notifying a presence of the floating when the floating detection unit determines that the floating is present.

DESCRIPTION OF EXEMPLARY EMBODIMENTS

First Embodiment

A first embodiment of the present disclosure will now be described. In this embodiment, the transport device according to the present disclosure is configured as an image scanner 10.

Figure 1:
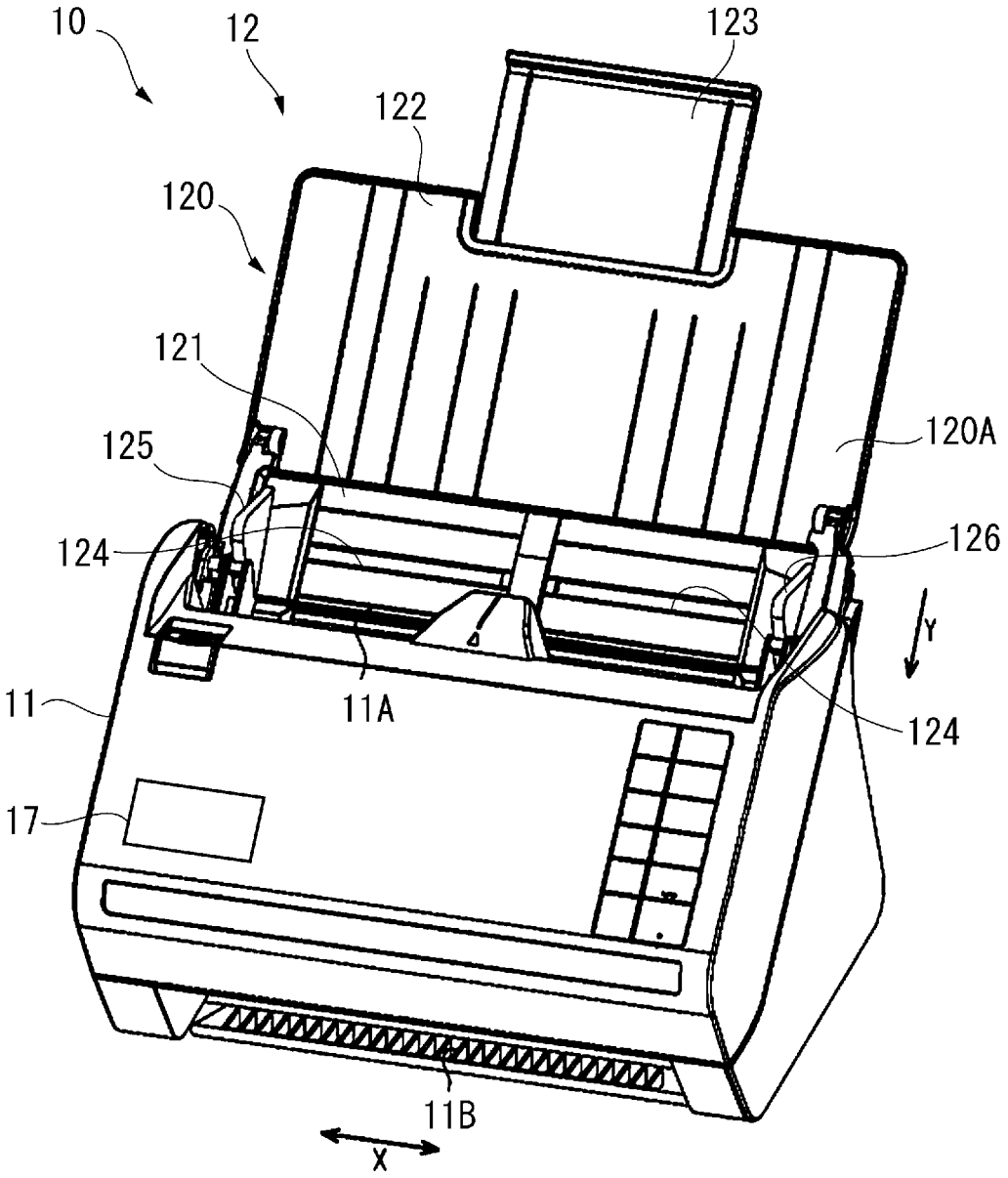
FIG. 1 is an external view showing a schematic configuration of an image scanner according to a first embodiment of the present disclosure.
Figure 2:
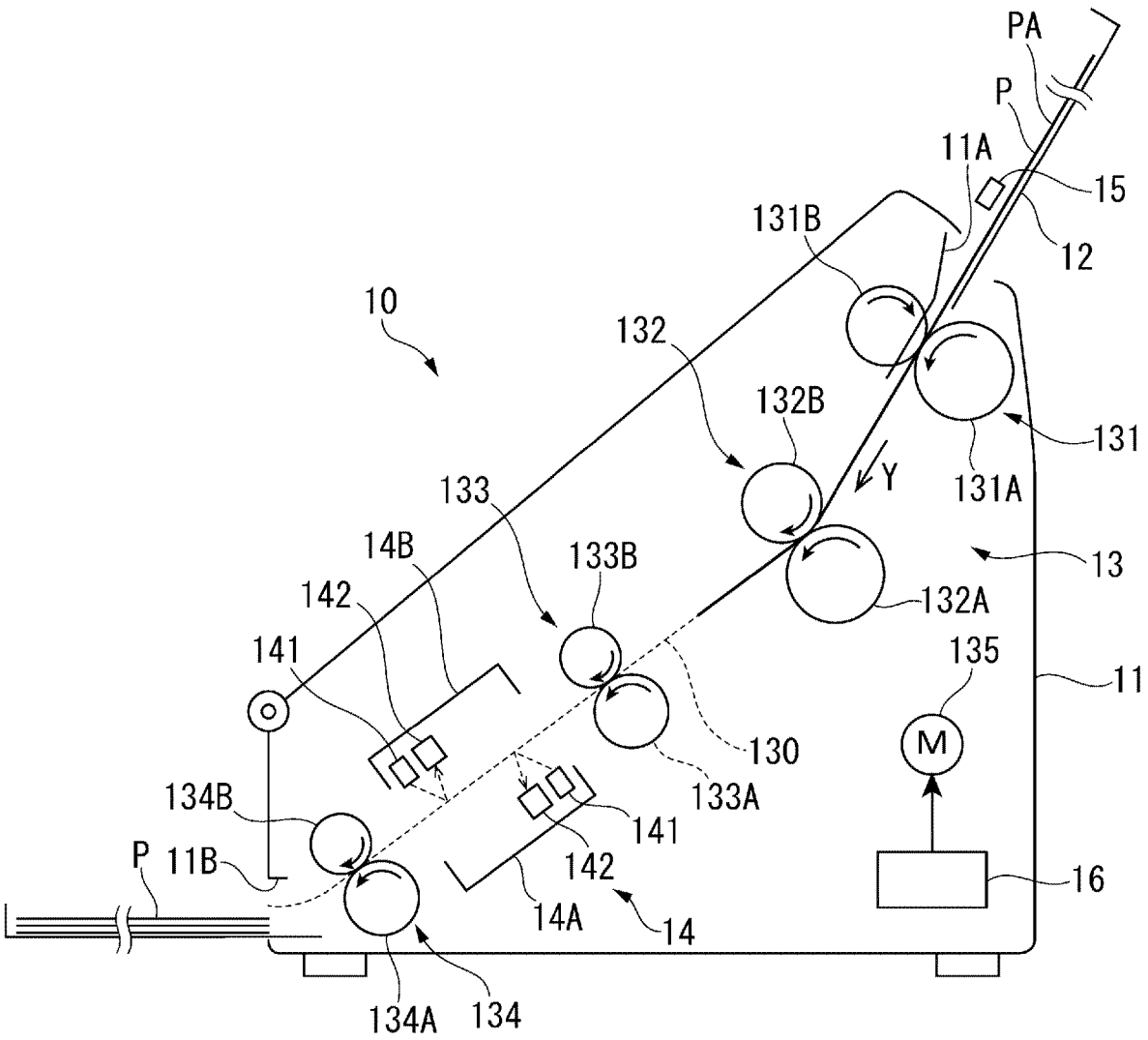
FIG. 2 is a side cross-sectional view schematically showing a transport unit of the image scanner according to the first embodiment.

FIG. 1 is an external view showing a schematic configuration of the image scanner 10 according to the embodiment. FIG. 2 is a side cross-sectional view schematically showing a transport unit 13 of the image scanner 10. FIG. 2 is a side cross-sectional view of the image scanner 10 as viewed into a direction along a main scanning axis (X-axis) orthogonal to a transport direction (direction along Y-axis).

Schematic Configuration of Image Scanner 10

As shown in FIG. 1, the image scanner 10 has a device main body 11 and a sheet support unit 12 (medium support unit). A transport unit 13 transporting a sheet P, a scanning unit 14 scanning an image on the transported sheet P, an ultrasonic sensor 15 detecting a floating of the sheet P, and a control unit 16 controlling the image scanner 10 are provided inside the device main body 11, as shown in FIG. 2. The device main body 11 also has a notification unit 17 provided at the outside of the device main body 11.

While an example of transporting the sheet P as a medium is described in this embodiment, this is not limiting. For example, various sheet-like media such as a film or fabric cloth can be transported.

As shown in FIGS. 1 and 2, a feed port 11A is provided at a coupling position to the sheet support unit 12, in the device main body 11. The sheet P supported by the sheet support unit 12 is fed, one by one, into the feed port 11A. The fed sheet P is transported along a predetermined transport path 130 inside the device main body 11, by the transport unit 13. After an image is scanned by the scanning unit 14 at a scanning position in the course of transport, the sheet P is discharged from a discharge port 11B opening at a front-bottom part of the device main body 11.

The sheet support unit 12 has a tray 120, and a first guide 125 and a second guide 126 provided at tray 120.

The tray 120 has a placement surface 120A where one or more sheets P are placed. A direction along the width of the sheet P placed at the placement surface 120A corresponds to the X-axis. In this embodiment, the tray 120 includes a first tray 121 provided near the feed port 11A of the device main body 11, and a flat plate-like second tray 122 coupled in such a way as to be able to pivot about base part. However, this is not limiting. The second tray 122 may be provided with an auxiliary tray 123 that can be pulled out from the second tray 122.

On the side of the placement surface 120A of the first tray 121, a groove 124 shaped along the X-axis is provided.

The first guide 125 and the second guide 126 are provided at the first tray 121 and configured to be movable along the groove 124.

Each of the first guide 125 and the second guide 126 is shaped to protrude away from the placement surface 120A of the tray 120. The first guide 125 and the second guide 126 are positioned along the X-axis according to the width dimension of the sheet P placed at the placement surface 120A and thus can come into contact with the sheet P from both sides of a direction along the X-axis.

Configuration of Transport Unit 13

As shown in FIG. 2, the transport unit 13 feeds a plurality of sheets P set at the tray 120 into the device main body 11 via the feed port 11A and transports the fed sheets P along the predetermined transport path 130. In this embodiment, the feed direction and the transport direction of the sheet P are the direction along the Y-axis. The direction along the Y-axis is a direction along a sheet surface PA of the sheet P that is fed or transported.

Specifically, the transport unit 13 has a first roller pair 131 arranged upstream (on the −Y side) along the Y-axis in the transport path 130, and a second roller pair 132 arranged downstream (on the +Y side) along the Y-axis from the first roller pair 131. The transport unit 13 also has a third roller pair 133 arranged on the −Y side of the scanning position of the sheet P, and a fourth roller pair 134 arranged on the +Y side of the scanning position of the sheet P.

The first roller pair 131 is formed of a first drive roller 131A and a first driven roller 131B. Similarly, the second roller pair 132 is formed of a second drive roller 132A and a second driven roller 132B. The third roller pair 133 is formed of a third drive roller 133A and a third driven roller 133B. The fourth roller pair 134 is formed of a fourth drive roller 134A and a fourth driven roller 134B. The driven rollers 131B to 134B are driven by (or rotate by following) the rotation of their respective paired drive rollers 131A to 134A.

The drive rollers 131A to 134A forming the respective roller pairs 131 to 134 are rotationally driven by the power of a transport motor 135, which is the power source of these rollers. The transport motor 135 is controlled by the control unit 16 and thus drives the respective drive rollers 131A to 134A.

Of the first roller pair 131, the first drive roller 131A, as a feed roller, feeds the plurality of sheets P placed at the tray 120 to the +Y side in order from the sheet P that comes into contact with the first drive roller 131A. The first driven roller 131B, as a retard roller, separates the sheets P entering between the first drive roller 131A and the first driven roller 131B, one by one. The method for separating the sheets P is not particularly limited, and for example, related-art techniques such as increasing the coefficient of friction of the first driven roller 131B to the sheet P or controlling the driving of the first driven roller 131B, can be used.

With such a first roller pair 131, the plurality of sheets P placed at the placement surface 120A of the tray 120 are sequentially fed, one by one, into the device main body 11 via the feed port 11A.

Configuration of Scanning Unit 14

The scanning unit 14 is provided at the scanning position to scan an image on the sheet P, specifically, between the third roller pair 133 and the fourth roller pair 134 in the transport path 130.

The scanning unit 14 includes a first scanning unit 14A and a second scanning unit 14B provided on both sides of the transport path 130. The scanning unit 14 is formed of a light source 141 configured to cast light onto the sheet P that is being transported, and an image sensor 142 extending along the main scanning axis (X-axis). When in a normal scanning mode to scan the front surface of the sheet P, the first scanning unit 14A performs a scanning operation. When in a double-side scanning mode to scan the front and back surfaces of the sheet P, both the first scanning unit 14A and the second scanning unit 14B perform a scanning operation. The light source 141 and the image sensor 142 forming the first scanning unit 14A and the second scanning unit 14B are coupled to the control unit 16 and perform scanning processing to scan an image on the sheet P under the control of the control unit 16.

Configuration of Ultrasonic Sensor 15

Figure 3:
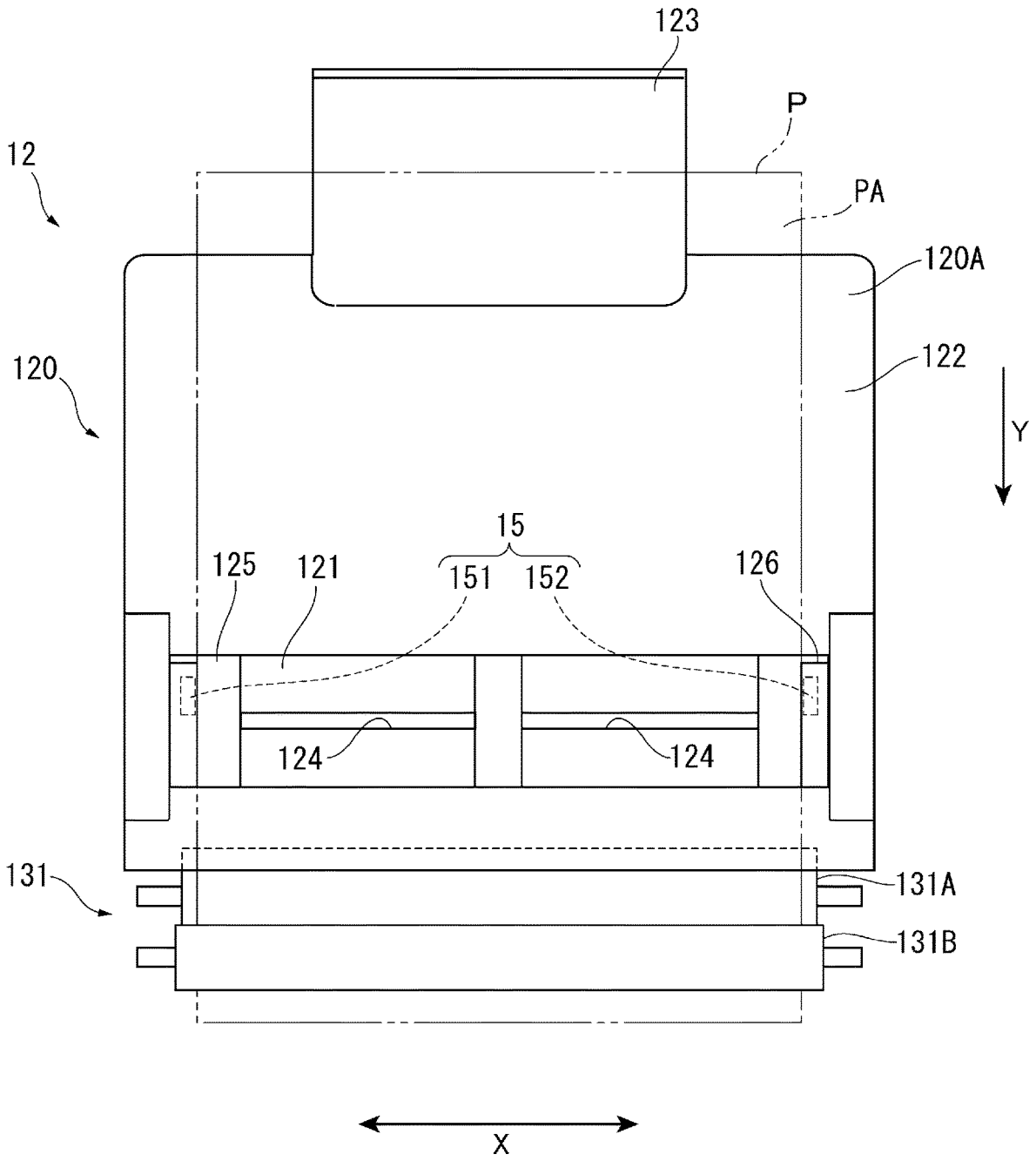
FIG. 3 is a plan view schematically showing an arrangement of an ultrasonic sensor in the first embodiment.

FIG. 3 is a plan view schematically showing an arrangement of the ultrasonic sensor 15 in this embodiment.

In this embodiment, the ultrasonic sensor 15 is a sensor detecting a floating of the sheet P placed at the placement surface 120A of the tray 120. The ultrasonic sensor 15 has an ultrasonic transmitting unit 151 and an ultrasonic receiving unit 152 for transmitting and receiving an ultrasonic wave, as shown in FIG. 3.

The ultrasonic transmitting unit 151 is provided at the first guide 125 and transmits an ultrasonic wave along the X-axis.

The ultrasonic receiving unit 152 is provided at the second guide 126 and arranged opposite the ultrasonic transmitting unit 151. The ultrasonic receiving unit 152 receives the ultrasonic wave transmitted from the ultrasonic transmitting unit 151 and outputs a received signal corresponding to the intensity of the received ultrasonic wave.

In this embodiment, each of the ultrasonic transmitting unit 151 and the ultrasonic receiving unit 152 is arranged at a position having a greater height from the placement surface 120A than the sheet P placed on the uppermost side when one or more sheets P are placed at the placement surface 120A.

Figure 5:
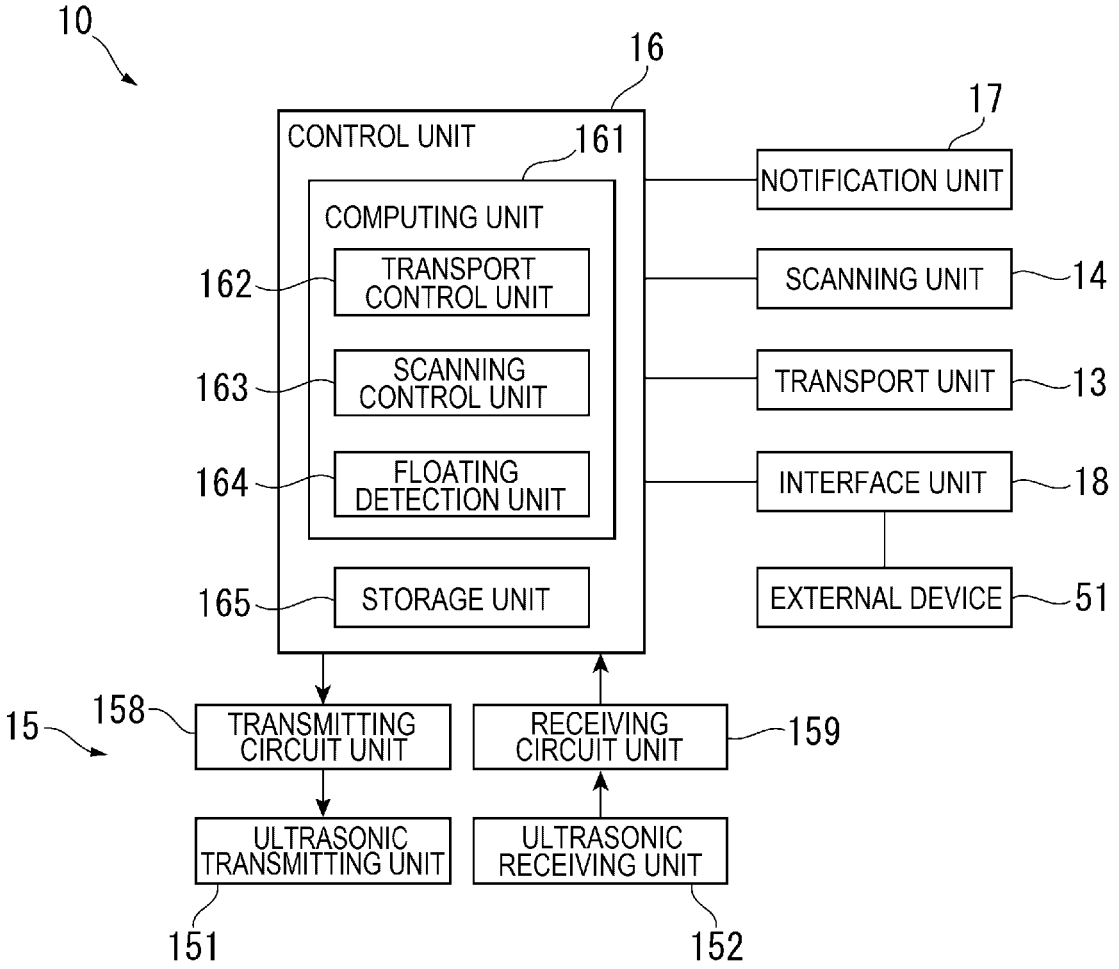
FIG. 5 is a block diagram showing a configuration to control the image scanner according the first embodiment.

The ultrasonic sensor 15 has a transmitting circuit unit 158 electrically coupled to the ultrasonic transmitting unit 151, and a receiving circuit unit 159 electrically coupled to the ultrasonic receiving unit 152, though not illustrated in FIG. 3 but as shown in FIG. 5, which is referred to later. The transmitting circuit generates a drive signal to drive each ultrasonic transducer of the ultrasonic transmitting unit 151, under the control of the control unit 16. The receiving circuit performs processing on the received signal outputted from the ultrasonic receiving unit 152 and outputs the resulting signal to the control unit 16.

Configuration of Ultrasonic Transmitting Unit 151

Figure 4:
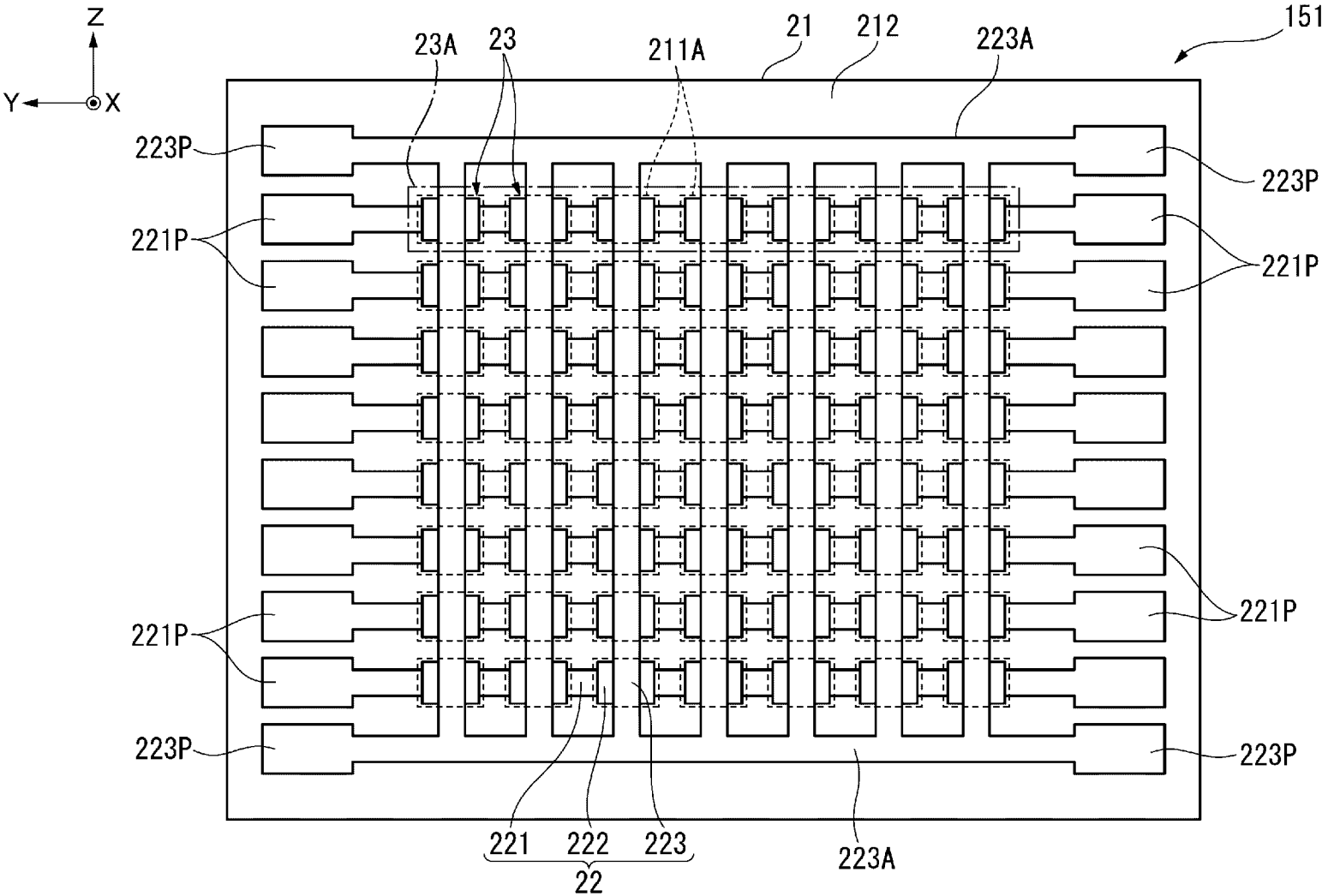
FIG. 4 is a plan view showing a schematic configuration of an ultrasonic transmitting unit in the first embodiment.

A schematic configuration of the ultrasonic transmitting unit 151 will be described with reference to FIG. 4. FIG. 4 is a plan view showing the schematic configuration of the ultrasonic transmitting unit 151 in this embodiment. In the description below, an axis orthogonal to the placement surface 120A is defined as the Z-axis.

As shown in FIG. 4, the ultrasonic transmitting unit 151 includes an element substrate 21 and a piezoelectric element 22.

The element substrate 21 has a substrate main body, not illustrated, and a vibration plate 212 provided at the substrate main body. The substrate main body has a thickness along the X-axis and is provided with a plurality of openings penetrating the substrate main body along the X-axis. The vibration plate 212 is provided on one surface side of the substrate main body so as to close these openings. Each of areas overlapping the openings, of the vibration plate 212, forms a vibration part 211A. That is, the element substrate 21 has a plurality of vibration parts 211A arranged in the shape of a two-dimensional array on a YZ plane.

The piezoelectric element 22 is provided at a position overlapping each vibration part 211A, over the element substrate 21. The piezoelectric element 22 is formed of a first electrode 221, a piezoelectric film 222, and a second electrode 223 stacked in this order at the element substrate 21.

The first electrode 221 is formed linearly, for example, along the Y-axis. Both ends (±Y-side ends) of the first electrode 221 are first electrode terminals 221P coupled to the transmitting circuit unit.

The second electrode 223 is formed linearly, for example, along the Z-axis. Both ends (±Z-side ends) of the second electrode 223 are coupled to a common electrode line 223A. The common electrode line 223A couples a plurality of second electrodes 223 arranged along the Z-axis. Both ends (±Y-side ends) of the common electrode line 223A are second electrode terminals 223P coupled to the transmitting circuit unit.

Here, one vibration part 211A and the piezoelectric element 22 provided over the vibration part 211A together form one ultrasonic transducer 23. A plurality of ultrasonic transducers 23 arranged along the Y-axis share one first electrode 221 and therefore form one ultrasonic channel 23A.

In such a configuration, as a drive signal is applied between the first electrode 221 and the second electrode 223, the piezoelectric film 222 expands and contracts and the vibration part 211A provided with the piezoelectric element 22 vibrates. Thus, an ultrasonic wave is transmitted from the vibration part 211A.

Configuration of Ultrasonic Receiving Unit 152

The ultrasonic receiving unit 152 can be formed substantially similarly to the ultrasonic transmitting unit 151. That is, the ultrasonic receiving unit 152 is configured to have the element substrate 21 and the piezoelectric element 22 as shown in FIG. 4. In each ultrasonic transducer 23 of the ultrasonic receiving unit 152, as the vibration part 211A receives an ultrasonic wave and vibrates, a received signal is outputted from the piezoelectric element 22.

In this embodiment, the sound pressure of an ultrasonic wave reaching the ultrasonic receiving unit 152 without being blocked by the sheet P is measured, thus determining whether a floating of the sheet P is present or not. Thus, in the ultrasonic receiving unit 152, one of the ultrasonic transducers 23 may receive the ultrasonic wave transmitted from the ultrasonic transmitting unit 151. Therefore, a plurality of ultrasonic transducers 23 may be coupled in series and the sum of signals outputted from the piezoelectric elements 22 of the respective ultrasonic transducers 23 may be outputted as a received signal.

Configuration of Control Unit 16

FIG. 5 is a block diagram showing a configuration to control the image scanner 10.

As shown in FIG. 5, the control unit 16 is coupled to the transport unit 13, the scanning unit 14, and the ultrasonic sensor 15, and controls the driving of these units. The control unit 16 also performs processing corresponding to a received signal received from the ultrasonic sensor 15 (floating detection processing, described later).

The control unit 16 is also coupled to an interface unit 18. The control unit 16 thus receives various data and signals inputted from an external device 51 such as a personal computer, and outputs scanned data scanned by the image scanner 10 to the external device 51.

Specifically, the control unit 16 has a computing unit 161 formed of a CPU (central processing unit) or the like, and a storage unit 165 formed of a recording circuit such as a memory.

In the storage unit 165, various data for controlling the image scanner 10 and various programs are recorded.

The computing unit 161 reads and executes the various programs stored in the storage unit 165 and thus functions as a transport control unit 162, a scanning control unit 163, and a floating detection unit 164 or the like, as shown in FIG. 5.

The transport control unit 162 controls the transport motor 135 of the transport unit 13 to rotate the plurality of rollers 131 to 134 and thus feeds the sheets P set at the sheet support unit 12, one by one into the device main body 11. The transport control unit 162 also transports the fed sheet P along the transport path 130.

The scanning control unit 163 controls the scanning unit 14 to scan an image on the sheet P during the transport of the sheet P.

The floating detection unit 164 determines whether a floating of the sheet P from the placement surface 120A of the tray 120 is present or not, using the ultrasonic sensor 15. That is, the floating detection unit 164 detects a floating of the sheet P. A specific processing method by the floating detection unit 164 will be described later.

Configuration of Notification Unit 17

The notification unit 17 is, for example, a display as shown in FIG. 1 and is provided at the device main body 11. The notification unit 17 is controlled by the control unit 16 and displays the result of the determination by the floating detection unit 164. When the floating detection unit 164 determines that a floating of the sheet P is present, the notification unit 17 notifies the user by displaying that a floating of the sheet P is present.

The notification unit 17 is not limited to the display and may be a light-emitting body which emits light when a floating of the sheet P is detected, or a sound-emitting body which outputs a sound when a floating of the sheet P is detected. The notification unit 17 may also be an arbitrary combination of notification measures such as display, light emission, and sound.

Floating Detection Processing

In this embodiment, when a plurality of sheets P stapled together are placed at the placement surface 120A of the tray 120, a phenomenon (floating) in which a sheet P floats up from the placement surface 120A of the tray 120 occurs when the sheets P are fed.

Figure 6:
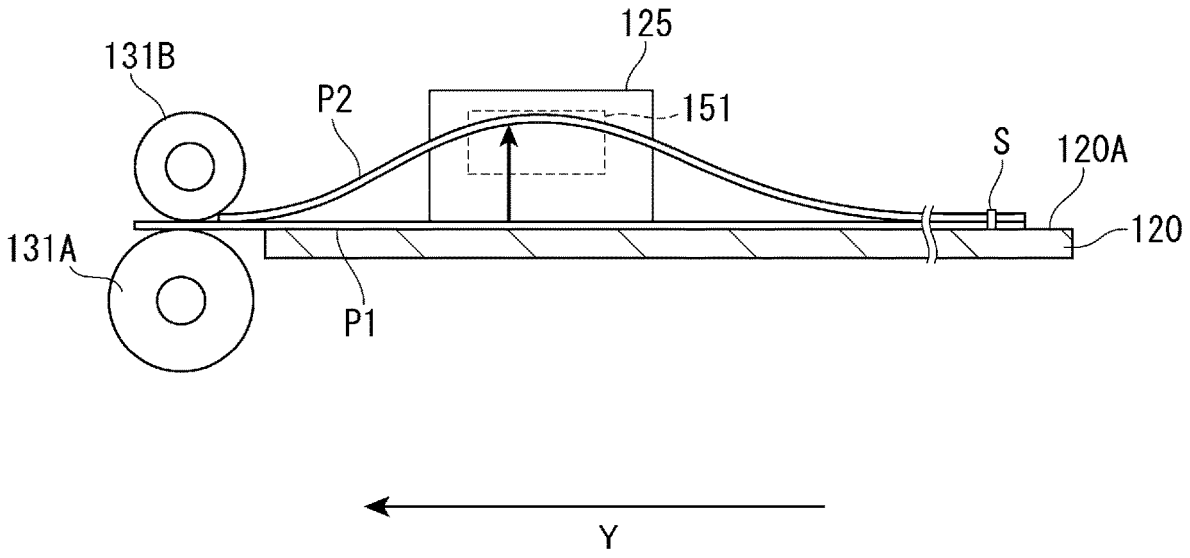
FIG. 6 is a schematic view for explaining an example of a floating of a sheet in the first embodiment.

For example, FIG. 6 is a schematic view for explaining an example of a floating of the sheet P. FIG. 6 shows the case where sheets P1, P2 stapled on the −Y side are placed at the placement surface 120A of the tray 120.

It is assumed that the sheets P1, P2 are stapled together by a staple part S at their corners on the −Y side and the +X side. The staple part S may be a staple or may be a stapled part of the sheets P1, P2 themselves.

As shown in FIG. 6, when the sheets P1, P2 are placed at the placement surface 120A of the tray 120, the sheet P1 coming into contact with the first drive roller 131A is fed to the +Y side. At this time, the other parts of the sheets P1, P2 than the corners coupled tighter by the staple part S are separated by the first driven roller 131B, and the sheet P2 stays on the side of the tray 120. Therefore, as the sheet P1 moves to the +Y side, the flexure of the sheet P2 along the Y-axis increases and a center part along the Y-axis of the sheet P2 floats up from the placement surface 120A of the tray 120.

Figure 7:
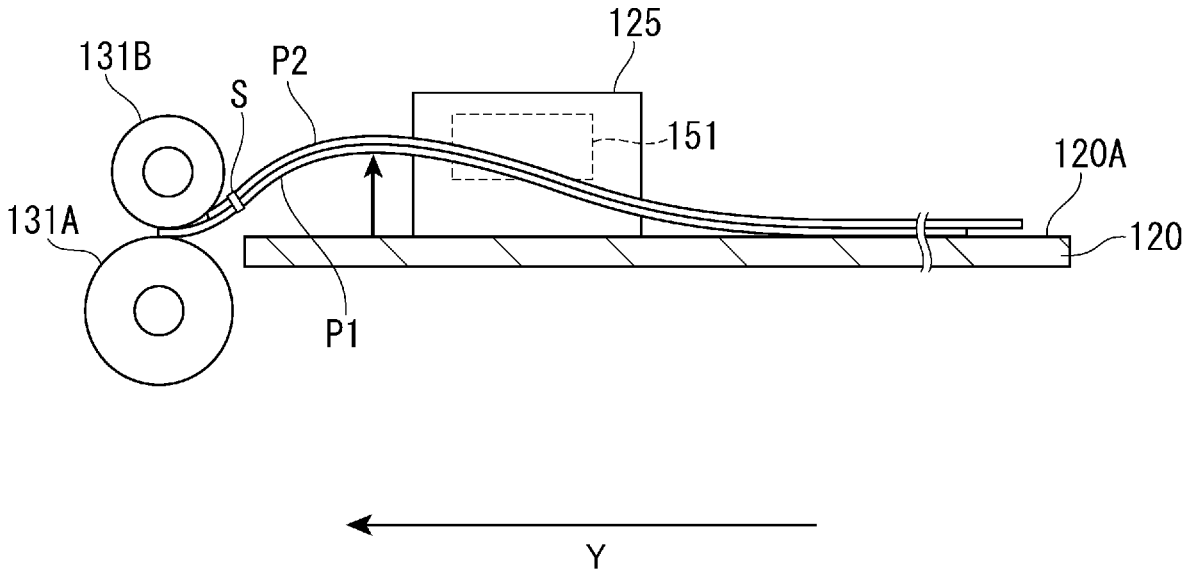
FIG. 7 is a schematic view for explaining another example of a floating of a sheet in the first embodiment.
Figure 8:
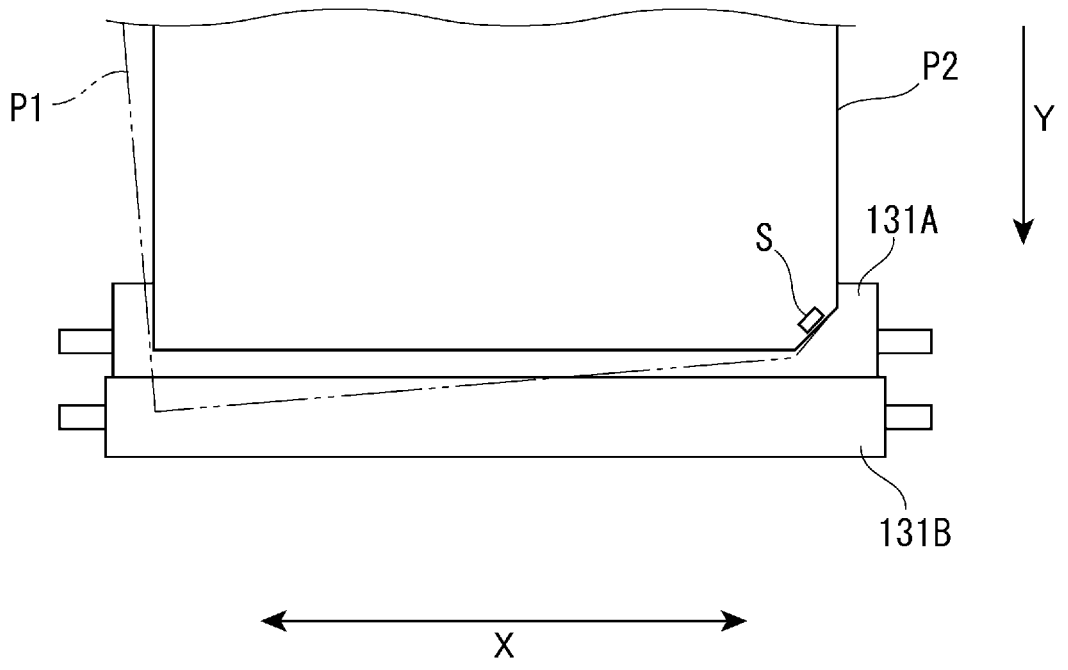
FIG. 8 is schematic view for explaining another example of a floating of a sheet in the first embodiment.

FIGS. 7 and 8 are schematic views for explaining an example of a floating of the sheet P. FIGS. 7 and 8 show the case where the sheets P1, P2 stapled together on the +Y side are placed at the placement surface 120A of the tray 120. It is assumed that the sheets P1, P2 are stapled together by the staple part S at their corners on the +Y side and the +X side.

As shown in FIG. 7, when the sheets P1, P2 are placed at the tray 120, the end on the +Y side of the sheet P1 comes into contact with the first drive roller 131A and is pressed toward the +Y side. The corner of this end receives a tensile force via the staple part S from the sheet P2 staying at the tray 120. This causes the sheet P1 to flex along the X-axis. Therefore, the sheet P1 laterally shifts (skews) as shown in FIG. 8 and a part of the sheet P1 along the X-axis floats up from the placement surface 120A of the tray 120.

Thus, in the image scanner 10 according to this embodiment, the floating detection unit 164 determines whether a floating of the sheet P is present or not, while the sheet P (P1 or P2) placed at the tray 120 is being fed.

Figure 9:
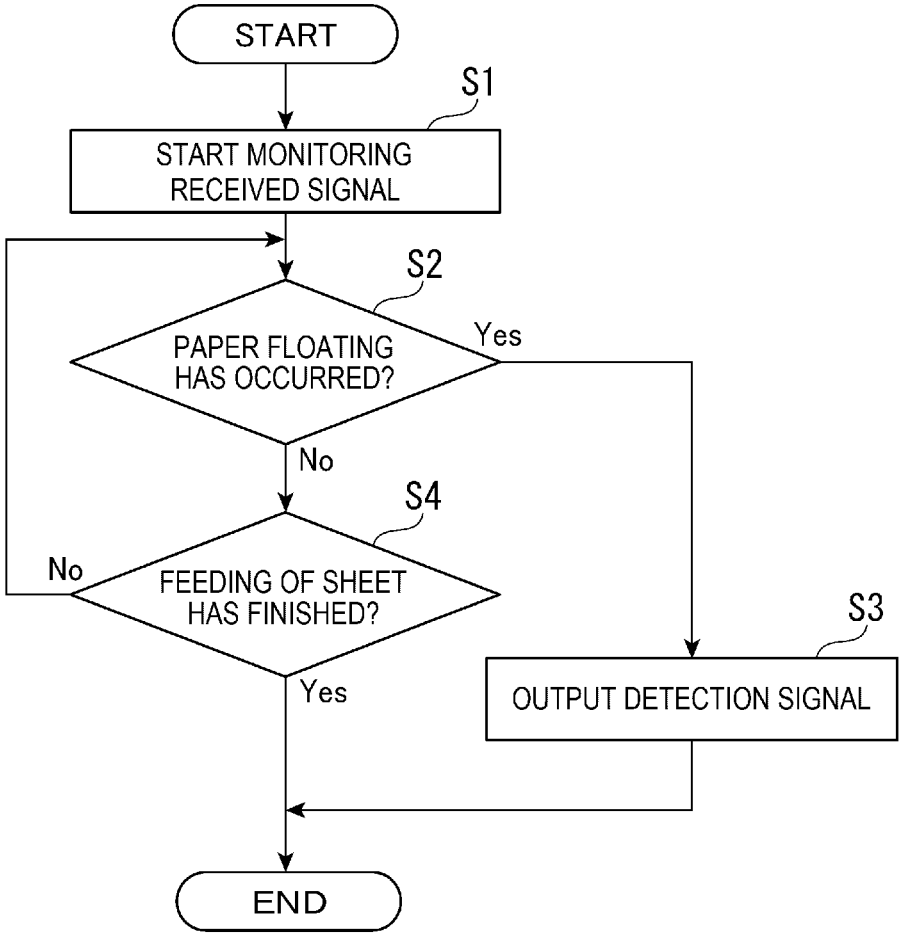
FIG. 9 is a flowchart for explaining floating detection processing in the first embodiment.

The floating detection processing in the image scanner 10 will now be described with reference to the flowchart of FIG. 9.

First, the floating detection unit 164 starts monitoring a received signal outputted from the ultrasonic sensor 15, when the sheet P placed at the placement surface 120A of the tray 120 starts to be fed (step S1).

Next, the floating detection unit 164 determines whether a floating of the sheet P has occurred or not, based on the voltage value of the received signal outputted from the ultrasonic sensor 15 (step S2).

For example, in the state where there is no floating of the sheet P placed at the placement surface 120A of the tray 120, an ultrasonic wave transmitted from the ultrasonic transmitting unit 151 is received by the ultrasonic receiving unit 152 without being blocked by the sheet P. In this state, the voltage value of the received signal outputted from the ultrasonic sensor 15 is a preset threshold T1 or higher.

Thus, when the voltage value of the received signal is the threshold T1 or higher, the floating detection unit 164 determines that there is no floating of the sheet P (No in step S2).

Meanwhile, as shown in FIG. 6 or 7, when a floating of the sheet P placed at the placement surface 120A of the tray 120 is present, an ultrasonic wave transmitted from the ultrasonic transmitting unit 151 is at least partly blocked by the sheet P floating up, and the ultrasonic wave received by the ultrasonic receiving unit 152 is reduced. Therefore, the voltage value of the received signal outputted from the ultrasonic sensor 15 changes to a lower value than the preset threshold T1.

Thus, when the voltage value of the received signal changes to a lower value than the threshold T1, the floating detection unit 164 determines that a floating of the sheet P has occurred (Yes in step S2), and outputs a detection signal (step S3). The flow thus ends.

As the detection signal is outputted from the floating detection unit 164, the transport control unit 162 controls the transport motor 135 to stop feeding the sheet P. The computing unit 161 causes the notification unit 17 to display (notify) that a floating of the sheet P is detected.

When a floating of the sheet P has not occurred (No in step S2), the floating detection unit 164 determines whether the feeding of the sheet P has finished or not (step S4). When it is Yes, the floating detection unit 164 ends the flow. When it is No, the floating detection unit 164 returns to step S2. That is, the floating detection unit 164 continues determining whether a floating of the sheet P is present or not, while the sheet P is being fed.

Advantageous Effects of Embodiment

The image scanner 10 according to this embodiment has: the sheet support unit 12 having the placement surface 120A where the sheet P (medium) is placed; the transport unit 13 transporting the sheet P placed at the placement surface 120A along the Y-axis; the ultrasonic transmitting unit 151 provided at a part of the sheet support unit 12; the ultrasonic receiving unit 152 provided at another part of the sheet support unit 12; and the floating detection unit 164 determining whether a floating of the sheet P from the placement surface 120A is present or not, based on a received signal outputted from the ultrasonic receiving unit 152.

In such a configuration, as a floating of the sheet P from the placement surface 120A of the tray 120 is detected, it can be detected that a plurality of sheets P stapled together are placed at the placement surface 120A of the tray 120. That is, before a jam occurs due to a plurality of sheets P stapled together, the cause of the occurrence of the jam can be detected. Therefore, measures such as stopping the transport of the sheet P can be taken early and the occurrence of the jam can be restrained.

The image scanner 10 according to this embodiment has the notification unit 17 notifying, when the floating detection unit 164 determines that a floating of the sheet P is present, the presence of the floating. Therefore, the user can learn that a floating of the sheet P has occurred, and can take measures such as eliminating the sheet P before a jam occurs.

In the image scanner 10 according to this embodiment, the sheet support unit 12 has the first guide 125 and the second guide 126 coming into contact with the sheet P placed at the placement surface 120A from both sides of a direction along the X-axis, and guiding the sheet P to the +Y side. The ultrasonic transmitting unit 151 is provided at the first guide 125. The ultrasonic receiving unit 152 is provided at the second guide 126.

In such a configuration, the ultrasonic transmitting unit 151 and the ultrasonic receiving unit 152, along with the first guide 125 and the second guide 126, are positioned according to the width dimension of the sheet P placed at the placement surface 120A, and are arranged at positions near the sheet P. Therefore, a floating of the sheet P can be detected more accurately.

Particularly, when a plurality of sheets P are stapled together on the −Y side, the related-art technique results in the occurrence of a jam after the sheets P separated on the +Y side are fed to the back of the device. Therefore, in the related-art technique, the sheets P is severely damaged and the device takes along downtime for recovery. Meanwhile, this embodiment can restrain the occurrence of such a jam.

Also, in this embodiment, since the ultrasonic sensor 15 is used as the sensor detecting a floating of the sheet P, a floating of the sheet P can be suitably detected even when the sheet P is highly light-transmissive.

Moreover, in this embodiment, since the ultrasonic sensor 15 is used as the sensor detecting a floating of the sheet P, the sensing range is broader and the change in the voltage value of the received signal is relatively gentler than when an optical sensor is used.

Therefore, the threshold T1 of the received signal may be properly set to distinguish and determine whether a small floating has occurred due to a crease or the like on the sheet P, or a large floating has occurred due to a plurality of sheets P stapled together.

Second Embodiment

A second embodiment will now be described.

The second embodiment is different from the first embodiment in the configuration of an ultrasonic sensor 15A and the determination processing by the floating detection unit 164. In the description below, an element that has already been described is denoted by the same reference sign and its description is omitted or simplified.

Figure 10:
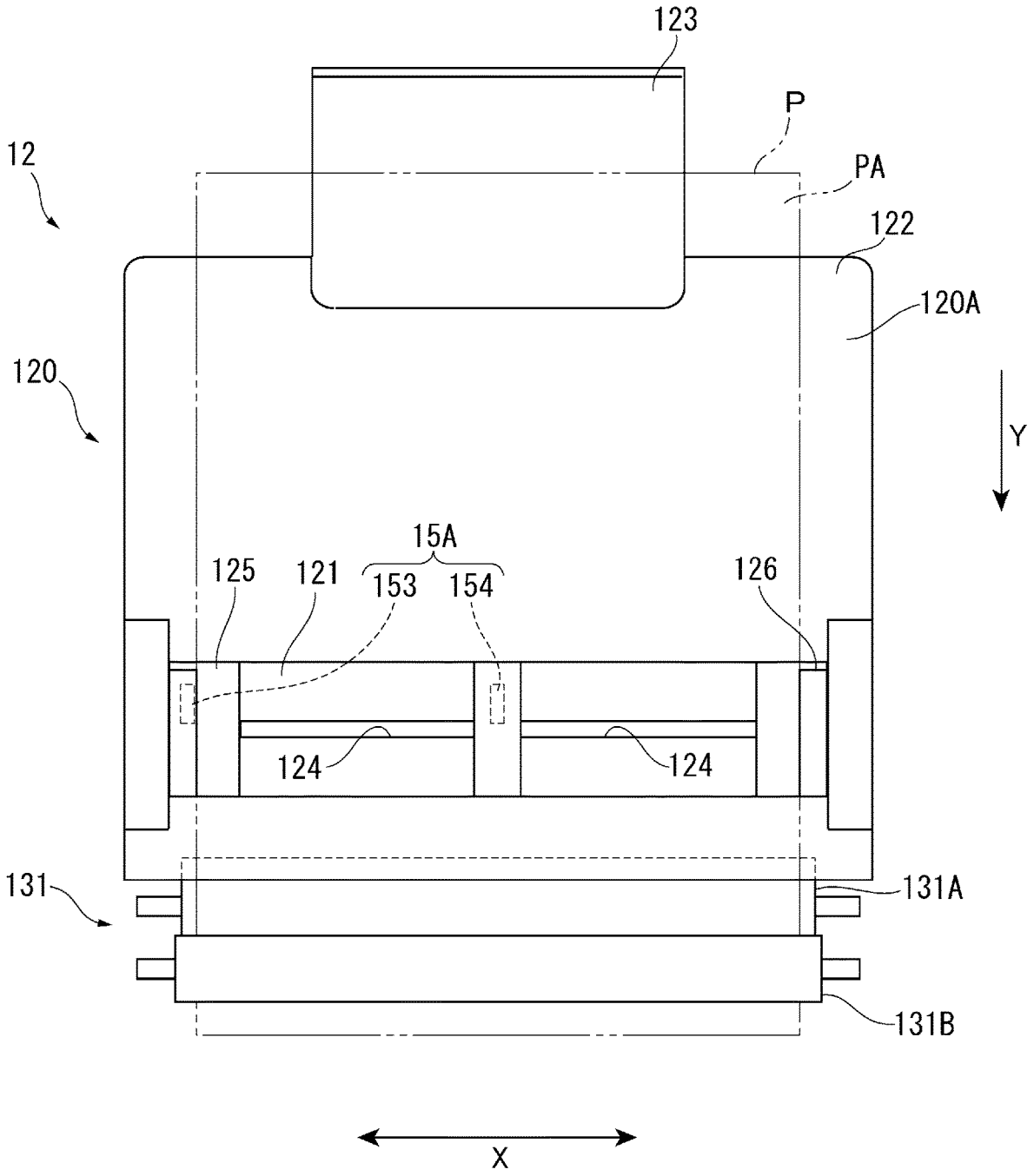
FIG. 10 is a plan view schematically showing an arrangement of an ultrasonic sensor in a second embodiment.
Figure 11:
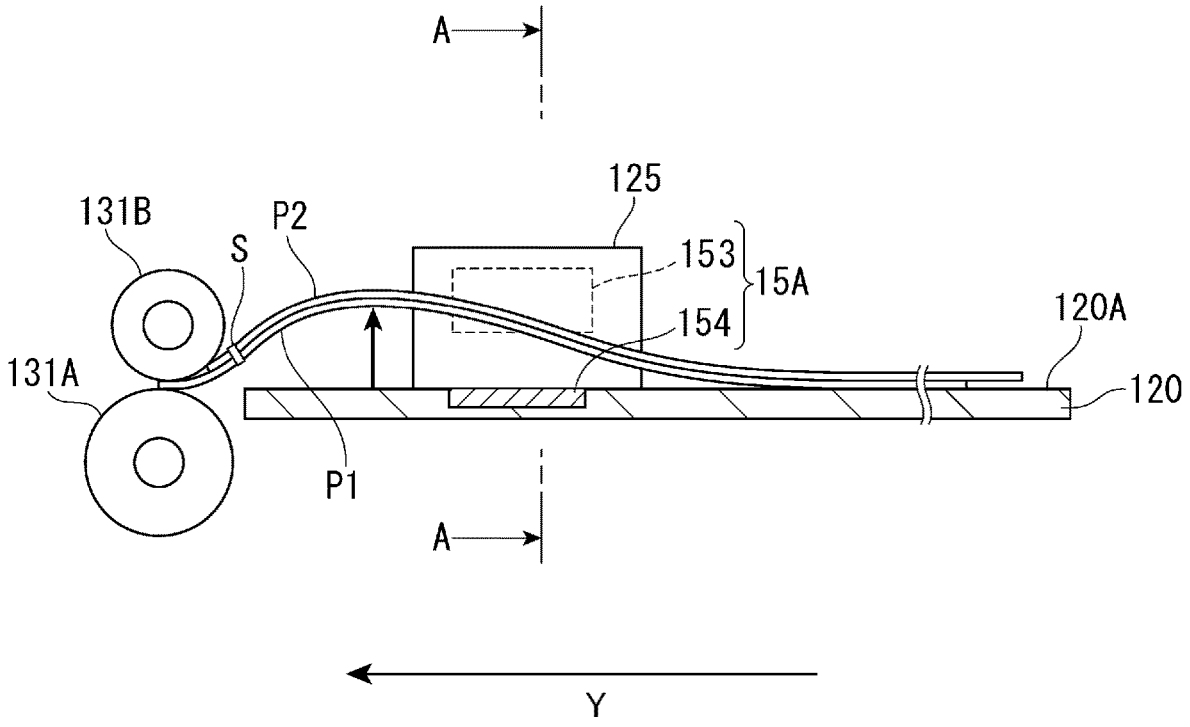
FIG. 11 is a schematic view for explaining an example of a floating of a sheet in the second embodiment.
Figure 12:
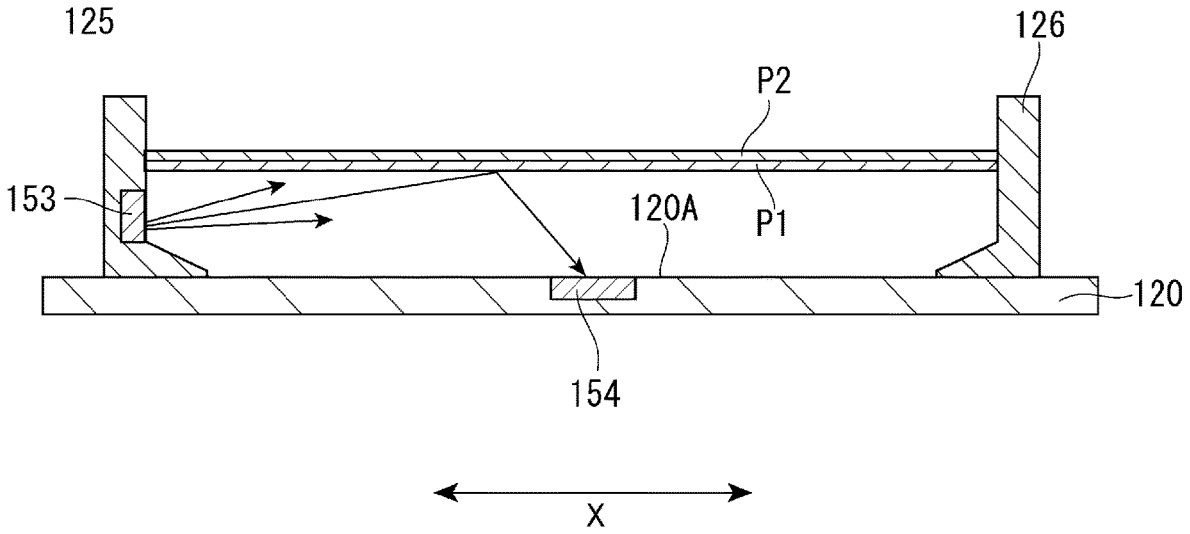
FIG. 12 is a cross-sectional view taken along A-A in FIG. 11.

FIG. 10 is a plan view schematically showing an arrangement of the ultrasonic sensor 15A in the second embodiment. FIGS. 11 and 12 are schematic views for explaining an example of a floating of the sheet P in the second embodiment. FIG. 12 is a cross-sectional view taken along A-A in FIG. 11.

As shown in FIG. 10, the ultrasonic sensor 15A has an ultrasonic transmitting unit 153 and an ultrasonic receiving unit 154 for transmitting and receiving an ultrasonic wave.

The ultrasonic transmitting unit 153 is provided at a protruding part of the first guide 125, similarly to the ultrasonic transmitting unit 151 in the first embodiment. However, in the second embodiment, the ultrasonic transmitting unit 153 is configured to transmit a plurality of ultrasonic waves into transmission directions having different angles to the XY plane as shown in FIG. 12, instead of transmitting an ultrasonic wave in one direction.

Here, the ultrasonic transmitting unit 153 may be configured to pivot by a predetermined angle about an axis of rotation via a pivot mechanism, or may include a plurality of ultrasonic transducers 23 tilted at different angles to the X-axis.

Alternatively, when the ultrasonic transmitting unit 153 has a plurality of ultrasonic channels 23A as shown in FIG. 4, the control unit 16 may control the transmission direction of the ultrasonic wave by varying the input timing of the drive signal to the plurality of ultrasonic channels 23A so that the transmission direction of the ultrasonic wave varies from one ultrasonic channel 23A to another.

The installation height of the ultrasonic transmitting unit 153 from the placement surface 120A is a height such that the ultrasonic transmitting unit 153 is arranged nearer to the placement surface 120A than the sheet P when a floating of the sheet P from the placement surface 120A occurs.

The ultrasonic receiving unit 154 is provided at the placement surface 120A of the tray 120, instead of at the second guide 126, and is arranged to face the sheet P placed at the placement surface 120A. The ultrasonic receiving unit 154 can be arranged at an arbitrary position in the placement surface 120A. However, the ultrasonic receiving unit 154 may be preferably arranged at a center part along the X-axis so as to be able to face sheets P of various sizes. Also, the ultrasonic receiving unit 154 may be preferably arranged at the same position as the ultrasonic transmitting unit 153 along the Y-axis.

The ultrasonic sensor 15A in the second embodiment is configured to detect that a floating of the sheet P1 placed nearest to the placement surface 120A has occurred, as shown in FIGS. 11 and 12.

For example, in the state where there is no floating of the sheet P placed at the tray 120, the sheet P covers the ultrasonic receiving unit 154 and an ultrasonic wave transmitted from the ultrasonic transmitting unit 153 is blocked by the sheet P and does not reach the ultrasonic receiving unit 154. In this state, the voltage value of the received signal outputted from the ultrasonic sensor 15A is lower than a preset threshold T2.

However, when a floating of the sheet P1 arranged nearest to the placement surface 120A occurs, a space is formed between the sheet P1 floating up and the placement surface 120A, as shown in FIGS. 11 and 12. At this time, the ultrasonic wave transmitted from the ultrasonic transmitting unit 153 travels, while being reflected off the sheet P1 or the placement surface 120A. At least a part of the ultrasonic wave reaches the ultrasonic receiving unit 154. Thus, the voltage value of the received signal outputted from the ultrasonic sensor 15A changes to a value equal to or higher than the preset threshold T2.

Thus, in the second embodiment, when the voltage value of the received signal changes to a value equal to or higher than the threshold T2 during the monitoring of the received signal, the floating detection unit 164 determines that a floating of the sheet P has occurred, and outputs a detection signal.

On receiving the detection signal from the floating detection unit 164, the transport control unit 162 controls the transport motor 135 to stop feeding the sheet P.

According to the second embodiment, similarly to the first embodiment, before a jam occurs due to a plurality of sheets P stapled together, the cause of the occurrence of the jam can be detected. Therefore, measures such as stopping the transport of the sheet P can be taken early and the occurrence of the jam can be restrained.

Also, the second embodiment has a configuration utilizing the nature of the ultrasonic wave of being reflected at the boundary between materials. When a floating of the sheet P occurs, the ultrasonic wave travels between the sheet P and the placement surface 120A. According to the second embodiment, a floating of the sheet P can be suitably detected even when the amount of floating of the sheet P is small.

Third Embodiment

A third embodiment will now be described.

The third embodiment is different from the first embodiment in the configuration of an ultrasonic sensor 15B. In the description below, an element that has already been described is denoted by the same reference sign and its description is omitted or simplified.

Figure 13:
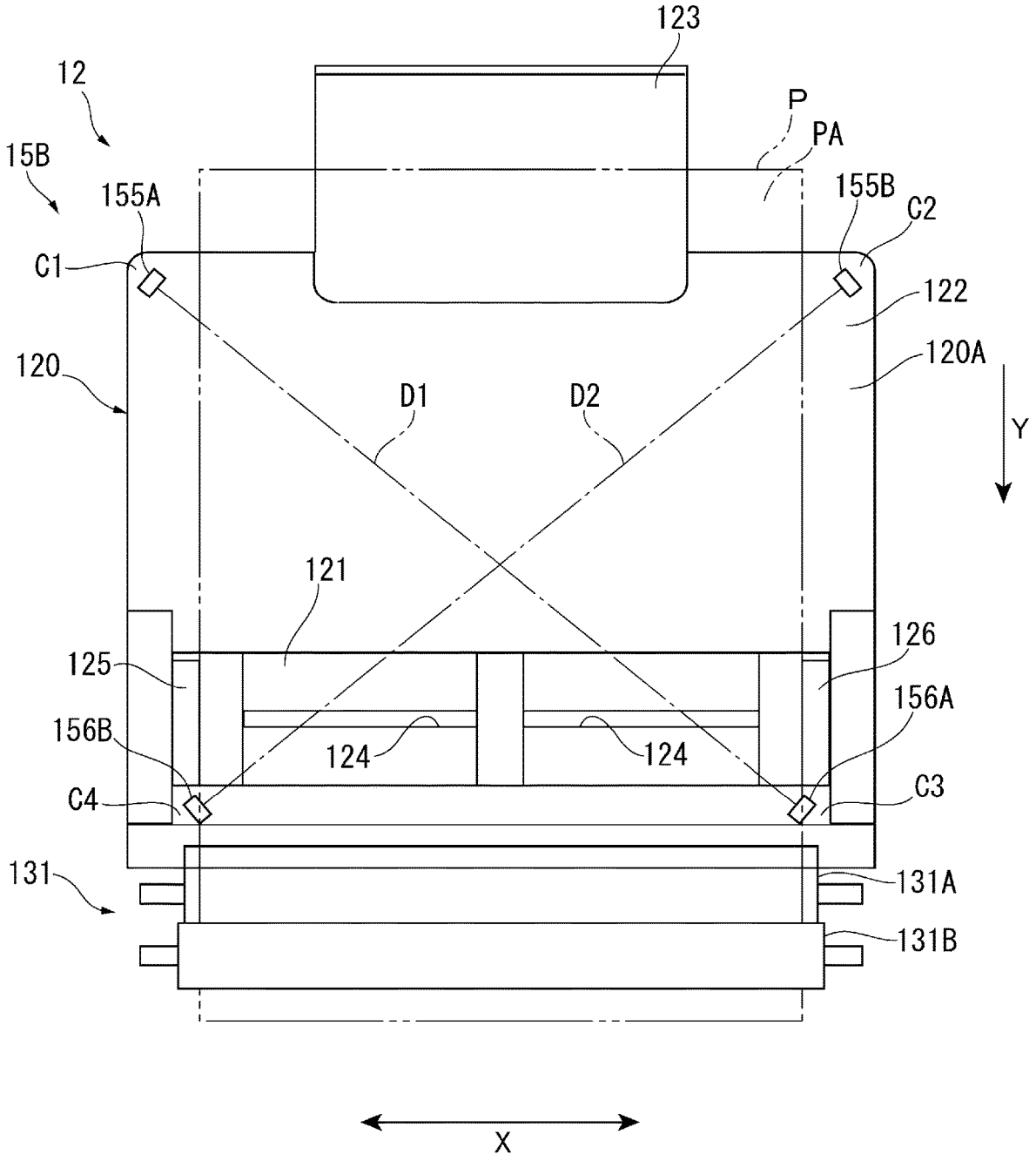
FIG. 13 is a plan view schematically showing an arrangement of an ultrasonic sensor in a third embodiment.

FIG. 13 is a plan view schematically showing an arrangement of the ultrasonic sensor 15B in the third embodiment.

As shown in FIG. 13, the ultrasonic sensor 15B has two sets of ultrasonic transmitting units 155A, 155B and ultrasonic receiving units 156A, 156B. These are provided at the tray 120.

Specifically, the ultrasonic transmitting unit 155A and the ultrasonic receiving unit 156A forming a pair are provided in corners C1, C3 on a diagonal line D1 of the tray 120. An ultrasonic wave transmitted from the ultrasonic transmitting unit 155A can be received by the ultrasonic receiving unit 156A.

The ultrasonic transmitting unit 155B and the ultrasonic receiving unit 156B forming a pair are provided in corners C2, C4 on a diagonal line D2 of the tray 120. An ultrasonic wave transmitted from the ultrasonic transmitting unit 155B can be received by the ultrasonic receiving unit 156B.

In such a configuration, the ultrasonic transmitting units 155A, 155B transmit an ultrasonic wave in a direction along the sheet surface PA of the sheet P and intersecting the Y-axis. The ultrasonic receiving units 156A, 156B receive the ultrasonic wave from the ultrasonic transmitting units 155A, 155B in the state where there is no floating of the sheet P.

The floating detection processing in the third embodiment is substantially similar to that in the first embodiment.

Specifically, the floating detection unit 164 receives a received signal outputted from the ultrasonic receiving unit 156A and a received signal outputted from the ultrasonic receiving unit 156B. When the voltage value of the received signal received from at least one of the ultrasonic receiving units 156A, 156B changes to a lower value than the threshold T1, the floating detection unit 164 determines that a floating of the sheet P has occurred, and outputs a detection signal.

On receiving the detection signal from the floating detection unit 164, the transport control unit 162 controls the transport motor 135 to stop feeding the sheet P.

According to the third embodiment, similarly to the first embodiment, before a jam occurs due to a plurality of sheets P stapled together, the cause of the occurrence of the jam can be detected. Therefore, measures such as stopping the transport of the sheet P can be taken early and the occurrence of the jam can be restrained.

Also, according to the third embodiment, the ultrasonic wave for detecting a floating of the sheet P is transmitted in the direction along the sheet surface PA of the sheet P and intersecting the Y-axis. Therefore, even when a floating occurs at various positions in the sheet P, the floating can be suitably detected.

MODIFICATION EXAMPLES

The present disclosure is not limited to the foregoing embodiments and includes modifications and improvements within a range that can achieve the object of the present disclosure and configurations provided by properly combining the embodiments together, or the like.

Modification Example 1

In the first and third embodiments, the floating detection unit 164 determines that a floating of the sheet P has occurred, when the received signal becomes lower than the threshold T1. However, this is not limiting.

For example, when a plurality of sheets P stapled together are placed at the tray 120, the flexure generated in the sheet P increases as the sheet P travels in the transport direction. Therefore, the height of the floating site of the sheet P from the placement surface 120A becomes higher as the sheet P travels in the transport direction. In this case, the floating site of the sheet P floats up to a position blocking the ultrasonic wave and subsequently floats further up and no longer blocks the ultrasonic wave.

Therefore, in the first and third embodiments, the floating detection unit 164 may determine that a floating of the sheet P has occurred, when the received signal becomes lower than the threshold T1 and subsequently becomes equal to or higher than the threshold T1 within a predetermined time. Thus, whether it is a floating due to a plurality of sheets P stapled together or a floating due to a crease on the sheet P can be accurately discriminated.

Modification Example 2

In the second embodiment, the ultrasonic transmitting unit 153 is provided at the first guide 125. However, the ultrasonic transmitting unit 153 may be provided at the second guide 126 or may be provided at both the first guide 125 and the second guide 126.

Alternatively, the ultrasonic transmitting unit 153 may be provided at the placement surface 120A of the tray 120, and the ultrasonic receiving unit 154 may be provided at least at one of the first guide 125 and the second guide 126.

Modification Example 3

In the second embodiment, the ultrasonic transmitting unit 153 is configured to transmit a plurality of ultrasonic waves into different transmission directions from each other. However, the ultrasonic transmitting unit 153 may be configured to transmit an ultrasonic wave in one direction. Due to its nature, an ultrasonic wave is transmitted to spread. Therefore, even when the ultrasonic transmitting unit 153 transmits an ultrasonic wave in one direction, the ultrasonic receiving unit 154 can receive the ultrasonic wave reflected off the sheet P when a floating of the sheet P occurs.

In the second embodiment, the ultrasonic transmitting unit 153 is configured to transmit a plurality of ultrasonic waves in transmission directions having different angles to the XY-plane. However, for example, the ultrasonic transmitting unit 153 may be configured to transmit a plurality of ultrasonic waves in transmission directions having different angles to the YZ-plane.

Modification Example 4

In the third embodiment, the ultrasonic sensor 15B has the two sets of ultrasonic transmitting units 155A, 155B and ultrasonic receiving units 156A, 156B. However, the ultrasonic sensor 15B may have one of these sets.

Modification Example 5

Each of the arrangements of the ultrasonic transmitting unit and the ultrasonic receiving unit according to the present disclosure is not limited to the arrangements described in the foregoing embodiments. That is, the ultrasonic transmitting unit and the ultrasonic receiving unit according to the present disclosure can be arranged at an arbitrary position in the sheet support unit 12, provided that a floating of the sheet P from the placement surface 120A can be detected from that position.

Also, a combination of the ultrasonic transmitting units 151, 153, 155A, 155B and the ultrasonic receiving units 152, 154, 156A, 156B in the foregoing embodiments may be provided at the sheet support unit 12.

Modification Example 6

In the foregoing embodiments, the floating detection unit 164 determines whether a floating of the sheet P is present or not, based on the change in the voltage value of the received signal. However, this is not limiting.

For example, according to the present disclosure, the ultrasonic transmitting unit and the ultrasonic receiving unit may form a distance sensor. In this case, the ultrasonic transmitting unit and the ultrasonic receiving unit may be provided at the placement surface 120A of the tray 120 and may measure the distance from the placement surface 120A to the sheet P. The floating detection unit 164 may determine that a floating of the sheet P has occurred, when the distance to the sheet P calculated based on the reception time of the received signal becomes equal to or longer than a threshold. Such ultrasonic transmitting unit and ultrasonic receiving unit may be formed as a unified body.

Modification Example 7

In the foregoing embodiments, the transport device according to the present disclosure is formed as the image scanner 10. However, the present disclosure is not limited to this. For example, the transport device according to the present disclosure may be formed as a printing device (printer) printing an image on the sheet P transported on the transport path 130.

What is claimed is:

1. A transport device comprising:

a medium support unit having a placement surface where a sheet-like medium is placed;

a transport unit supplied with the medium placed at the placement surface and transporting the medium in a transport direction along a sheet surface of the medium;

an ultrasonic transmitting unit provided at a part of the medium support unit and transmitting an ultrasonic wave;

an ultrasonic receiving unit provided at another part of the medium support unit, and receiving the ultrasonic wave and outputting a received signal; and a floating detection unit determining whether a floating of the medium from the placement surface is present or not, based on the received signal, wherein the ultrasonic transmitting unit and the ultrasonic receiving unit are located apart from each other when viewed in a direction perpendicular to the placement surface, the medium support unit has a first guide and a second guide coming into contact with the medium placed at the placement surface from both sides of a direction along the sheet surface and orthogonal to the transport direction, and guiding the medium in the transport direction, and one of the ultrasonic transmitting unit and the ultrasonic receiving unit is provided at the first guide or the second guide, and the other is provided at the placement surface.

2. The transport device according to claim 1, wherein the ultrasonic transmitting unit transmits a plurality of the ultrasonic waves in different transmission directions.

3. The transport device according to claim 1, wherein the ultrasonic transmitting unit transmits the ultrasonic wave in a direction along the sheet surface and intersecting the transport direction.

4. The transport device according to claim 1, further comprising:

a notification unit notifying a presence of the floating when the floating detection unit determines that the floating is present.

* * * * *